US008079297B1

(12) United States Patent
Kocher

(10) Patent No.: US 8,079,297 B1
(45) Date of Patent: Dec. 20, 2011

(54) ERODING PARTICLE ARMOR

(75) Inventor: Robert W. Kocher, Arlington, VA (US)

(73) Assignee: The Right Problem LLC, Arlington, VA (US)

( * ) Notice: Subject to any disclaimer, the term of this patent is extended or adjusted under 35 U.S.C. 154(b) by 291 days.

(21) Appl. No.: 12/213,378

(22) Filed: Jun. 18, 2008

Related U.S. Application Data

(60) Provisional application No. 60/960,748, filed on Oct. 11, 2007.

(51) Int. Cl.
*F41H 11/00* (2006.01)

(52) U.S. Cl. ..... 89/36.17; 109/36; 109/37; 89/902; 89/917

(58) Field of Classification Search ..... 89/36.17; 109/36, 37
See application file for complete search history.

(56) References Cited

U.S. PATENT DOCUMENTS

| | | | | |
|---|---|---|---|---|
| 3,638,573 | A * | 2/1972 | Campbell | 102/364 |
| 4,867,077 | A * | 9/1989 | Marlow et al. | 109/36 |
| 5,421,238 | A | 6/1995 | Catalano | |
| 5,637,824 | A * | 6/1997 | Benyami | 89/36.17 |
| 6,327,955 | B1 * | 12/2001 | Kerdraon et al. | 89/36.17 |
| 7,509,903 | B2 * | 3/2009 | Facciano et al. | 89/1.14 |
| 2004/0050239 | A1 * | 3/2004 | Benyami et al. | 89/36.17 |
| 2006/0054013 | A1 * | 3/2006 | Rodney et al. | 89/36.02 |
| 2006/0086243 | A1 * | 4/2006 | Seo et al. | 89/36.17 |
| 2006/0162539 | A1 * | 7/2006 | Fucke et al. | 89/36.17 |
| 2007/0221052 | A1 * | 9/2007 | Woodfin | 89/36.09 |

* cited by examiner

*Primary Examiner* — Michael Carone
*Assistant Examiner* — Samir Abdosh
(74) *Attorney, Agent, or Firm* — Andrew K. Wichmann

(57) ABSTRACT

A contained volume of particulate materials that is optimized for eroding ballistic penetrator, explosively formed penetrators, shaped charges, ballistic fragments, and other ballistic threats. The particulate materials include crushed garnet, crushed ceramics and sand. The volume of particulate materials may be mixed with explosive rods or pills. These explosive rods or pills ignite when the ballistic threat reaches a preset area within the armor box. Particulate material and armor boxes can consist of configurations using ballistic balls and irregular shaped stones or gravel. Alternate embodiments may contain configurations utilizing ballistic rods, electronic timing devices, and explosive detonators.

14 Claims, 13 Drawing Sheets

ERODING PARTICLE ARMOR

CROSS-REFERENCE TO RELATED APPLICATIONS

Provisional Patent Application No. 60/960,748 Filing Date 10 Nov. 2007.

BACKGROUND

Over the past few decades conventional armor technologies have proven ineffective in protecting against explosively formed projectiles (EFPs). An EFP is a special type of shaped charge designed to penetrate armor. It usually consists of a hardened metal canister containing a high explosive charge. One end of the canister is capped with a less dense metal such as copper. When the charge is ignited the copper end becomes molten and is forced apart of the canister. If the composition of the copper and charge is calibrated correctly, the material will elongate into a molten jet projectile during the explosion.

The resulting projectile can travel up to several kilometers a second and literally melt through conventional armor. In its most destructive form, an EFP forms multiple projectiles which impact the armor in successive slugs; these successive slugs are spaced a very small fraction of a second apart, so that each subsequent slug impact the target at the same spot as the preceding one, thereby benefiting from each previous slug's partial penetration of the target. Within conventional plate armor, the intense heat of a projectile slug instantaneously solidifies and stabilizes the route of entry for successive slugs. Multiple projectile EFPs can penetrate even the heaviest conventionally armored vehicles.

The vulnerability of conventional armored vehicles against EFPs is particularly evident in Iraq. In 2007 an entirely new vehicle program was begun to combat the increasing threat from EFPs. The vehicles in this program, called Mine Resistant Armor Protected II (MRAP II), are upgrades on an existing class of vehicles (MRAP I) which were at one time considered adequate to protect US forces from shaped charges.

The predominant design strategy for new MRAP I and MRAP II vehicles as well as other vehicle initiatives involves applying increased quantities of conventional armor to heavier chassis. Although this strategy typically meets the protection goals, it carries at least four significant drawbacks.

First, what were once considered "light" armored vehicles now carry upwards of five to six thousand additional pounds of armor. This not only adds significant costs, but also begins to defeat the purpose of having a "light" vehicle in the first place. Second, the additional weight naturally makes these formerly light vehicles difficult and expensive to transport. Third, these vehicles are typically manufactured in a permanent configuration. Thus, once a vehicle's armor is damaged, the entire vehicle must be taken out of operation for repairs. Fourth, since the vehicles are deployed in a permanent configuration, they are inherently inflexible to changing threats. If a vehicle is designed to respond to a particular threat and that threat changes, the vehicle's utility is greatly diminished.

SUMMARY

Eroding Particle Armor (EPA) employs a defeat mechanism which protects against multiple projectile EFPs and allows for solutions to all four of the above disadvantages. EPA consists of contained volumes of one or more particulate materials including crushed garnet, crushed ceramics, and/or sand and or other materials.

While testing a wide variety of armor materials against EFPs, it was discovered that volumes of particulate materials including garnet, ceramics, and sand, for example, offered surprisingly strong resistance. Although the precise physics of the reaction of these materials is not yet clear, it is generally thought that their mechanical and materials properties disrupt the focal point of an impacting EFP projectile. The impact angle of the projectile is continually altered as it interacts with particulate materials until the force is distributed to such a degree that inbound penetration is halted.

FIG. 1 depicts the initial tip or lead penetrator 17 partially penetrating its target 14 which contains eroding particle armor 10 and creating an opening behind it 16 which can be used by the next EFP slug a small fraction of a second later. The proposed armor structure is depicted in FIG. 2, which shows a number of layers of optionally different composition: layers 11, 12, and 10 respectively. Layer 15 is the interface between layers 11 and 12, and layer 14 is the rearmost interface layer to the inside of the armoring.

Additionally, small explosive pills can be included in the volume of particulate materials, as shown in FIG. 2. These explosive pills are used to enhance the defeat mechanism. These of the pills that are nearest the impacting EFP slug explode when the initial EFP slug impacts. The reactive explosion of the pill works to collapse the route of entry of the initial slug. This keeps the successive slugs from building on the penetration of the initial slug. As shown in FIG. 4, the initial EFP projectile 18 enters the volume of the target 17 which contains the explosive pills. Additionally, when those explosive pills detonate just in front of the EFP projectile 18, they generate a highly abrasive volume of corrosive solids that wear down the projectile 17 in addition to creating a back-pressure that the incoming projectile is being exposed to. Since this back pressure is not axially symmetric, the offending projectile' path is changed from a straight line to a curved one.

EPA offers advantages over conventional armor in weight, transportability, sustainability, and flexibility. First, even large volumes of eroding particulate materials weigh considerably less than conventional armor. Second, this decreased weight allows for lower transportation costs. Third, maintenance on a contained volume of particulate material can be done on location, whereas conventionally armored vehicles must be removed to special repair facilities. Lastly, the mixture of particulate materials in EPA can be locally altered to provide protection against evolving threats. In contrast conventional armored vehicles must be recalled and re-armored before they can respond to a significant new threat.

DRAWINGS

Reference Numerals

10 erosion particulate material
11 erosion material type 2
12 erosion material type 3
14 armored box
15 material divider
16 hole or cavity made by penetrator
17 initial projectile or penetrator
18 follow on penetrator of segment
19 new hole or cavity made by 2nd penetrator
20 explosive segment
21 exploding segment
22 explosive rod
23 exploding rod
25 second penetration sensor

26 penetration sensor and trigger control unit
27 explosive primer
28 wire connecting the explosive primer and sensor-trigger unit
30 first sensor that determine a penetration occurred and the penetration's location
31 wire connecting between the second penetration sensor and trigger control unit
40 armor ball
41 fractured armor ball
42 ballistic plate
43 fractured ballistic threat
44 granite/small rocks
45 thick armor plate

DRAWINGS

FIG. 1 ballistic box containing erosion material
FIG. 2 ballistic box containing sections of erosion materials or spaces
FIG. 3 ballistic box with erosion materials and explosive segments
FIG. 4 ballistic box with reacting explosives
FIG. 5 ballistic box with explosive rods and firing system
FIG. 6 ballistic box with ignition of explosive rods
FIG. 7 projectile effector box with 3 rows of ballistic balls
FIG. 8 projectile effector box with 2 rows of ballistic balls
FIG. 9 projectile effector box with damaged projectile
FIG. 10 projectile effector box with heavy back plate
FIG. 11 projectile effector box with heavy back plate two rows
FIG. 12 two projectile effector boxes working in tandem
FIG. 13 projectile effector box with granite, crushed ceramics or rocks

OPERATION

In operation EPA protects against EFPs as well as other armor-penetrating threats. The following effects allow EPA to defeat EFPs as well as exhibit superiority to conventional armor in weight, transportability, sustainability, and flexibility:

(1) The low density and high friction of certain particulate materials disrupts the focal point of impacting EFP projectiles, distributing their force at varying angles until penetration is halted.
(2) The reactions of explosive pills collapse the penetration paths of EFP slugs.
(3) The particulate materials offer substantial weight savings over conventional armor.
(4) The substantial weight savings of particulate materials offer substantial savings in transportation costs over conventional armor.
(5) The maintenance of a contained volume of particulate materials can be performed while deployed.
(6) The mixture of particulate materials in EPA can be locally altered to provide protection against evolving threats.
(7) Effector boxes blunt, fracture, rotate, or disperse the projectile thereby allow other follow-on armors or base armors to stop the damaged/weakened projectile.

FIG. 1 is a side view of a potential configuration of EPA. The box 14 contains particle armor 10 which can consist of an erosion composition such as garnet, silicon, glass, and crushed ceramics. As shown in FIG. 1, the armored box 14 contains an erosion material 10 that erodes or wears down the initial penetrator 17 as the penetrator 17 enters the armored box 14. The penetrator 17 creates a hole or cavity 16. The armored box 17 is thick enough to eventually slow down, erode the initial penetrator 17 until it is reduced to a small slug and stops.

FIG. 2 is a cross sectional view of a volume of particulate material. It is shown to consist of a number of different layers—in this case three—but one can have fewer or more layers as well.

FIG. 2 is an alternative configuration the uses different types of erosion materials 10, 11, 12 in a configuration where different erosion materials uses in combination can optimize defeating projectiles as they initially strike the armored box 14 at a very high velocity and slow down as it moves though the armored box 14. Spaces may be used to reduce overall weight and allow the eroded projectile to rotate or expand before impacting the next series of erosion particle armor 10.

FIG. 3 is a cross sectional view of a volume of particulate material 10 into which there are numerous pre-placed explosive pills 20. FIG. 3 is a similar configuration as FIG. 1 with the addition of explosive segments 20. These explosive segments 20 are sensitive to pressure and when the penetrator 17 hits or comes in the vicinity of the explosive segments 20. In FIG. 4 the penetrator 17 ignites the explosive segments 21 forcing erosion material 10 to close the cavity 16 behind the projectile 17. Once this cavity 16 is closed the follow penetrator segments must impact erosion particle armor 10 rather then fly through the hole 16 created by the first penetrator 17 The explosive segments can also provide force to slow down the penetrator or exert rotational and lateral pressures on the penetrator 17.

FIG. 4 is a cross-sectional view the armoring that consists of both the layers of abrasive material 10 and of numerous explosive pills 20; those explosive pills that in the incoming EFP's17 projected path are shown to explode and cause a back pressure to that EFP as well as generating a large amount of abrasion and corrosion on the incoming EFP 17.

FIG. 5 is a cross-sectional view a modified armor 10 which incorporates explosive rods 22 in it. As the EFP 17 enters the armor and reaches the triggering surface 25, that surface 25 causes a command to be generated by a control module 26 for the explosive rods 22 to detonate in response to the firing of the detonation cap 14 controlled by a conductor 28. FIG. 5 shows the use of explosive rods 22. These rods 22 are initiated by a control unit 26 after receiving information from sensors in side the armored box inner surface and a depth of penetration internal sensors determining the projectile's velocity and location.

FIG. 6 shows exploding rods 23 driving eroding particulate material 10 back into the initial cavity 16 created by the first penetrator 17 thereby closing or providing pressures on the second penetrator 18.

While the preceding figures depict a two dimensional structure for ease in conveying the essence of the invention, the structure invented is a three-dimensional one. The explosive rods are placed equally spaced in a symmetric three dimensional lattice. When an EFP hits the triggering membrane 25 in FIG. 5, the control circuitry 26 activates a select number of exploding rods (in three dimensions) closest to the path of the EFP to detonate, thereby sealing the hole made by—and left behind by—that EFP all the way around. This way, the next EFP in the multiple EFP attack finds a sealed hole that is no more penetrable—and probably less so—than if the first EFP had not preceded it. In the case of a rocket propelled grenade (RPG) or shaped charge penetration jets, the abrasive material media is moved by internal detonation of explosive into the jet's stream.

FIG. 7 shows an effector element that consists of ballistic balls 40 that can be composed of steel, ceramic, glass or composite materials arranged in a patter that will cause the incoming penetrator 17 to deform, flatten, or fracture as it exits the second ballistic plate 42. The ballistic plate 42 serves two purposes. The first is to provide additional material to blunt the incoming penetrator 17 and second is to contain the ballistic balls 40. The ballistic ball 40 alignment is important such that the incoming penetrator 17 flows around the balls thus dispersing and blunting the penetrator's tip.

Figure 10:
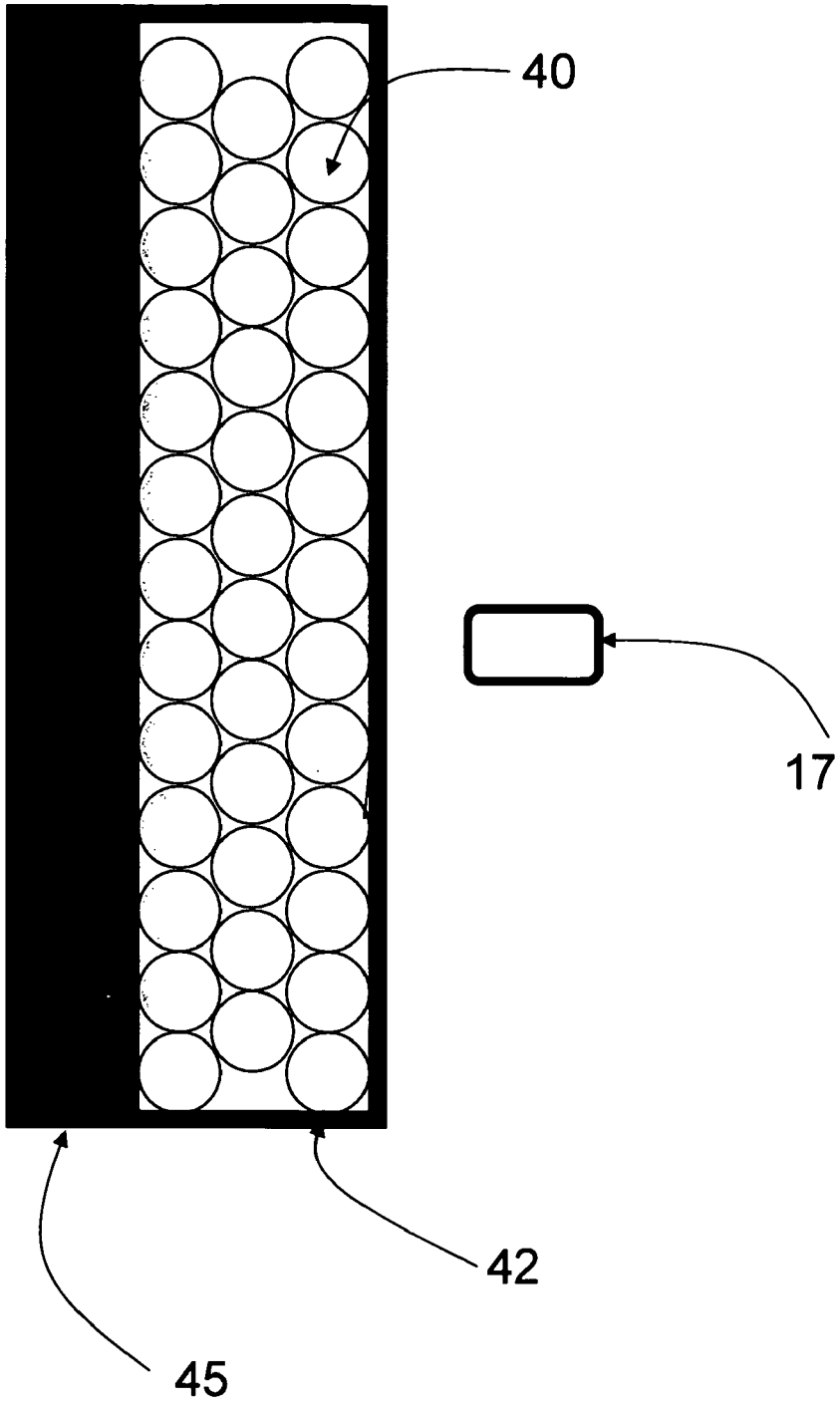

FIG. 10 shows the ballistic ball array with a heavy back plate. The system functions on the incoming penetrator 17 buy blunting, fracturing, and rotating the penetrator 17 as it impacts the ballistic balls 40 in preparation for impacting the heavy back plate armor or vehicle bass armor.

Figure 11:
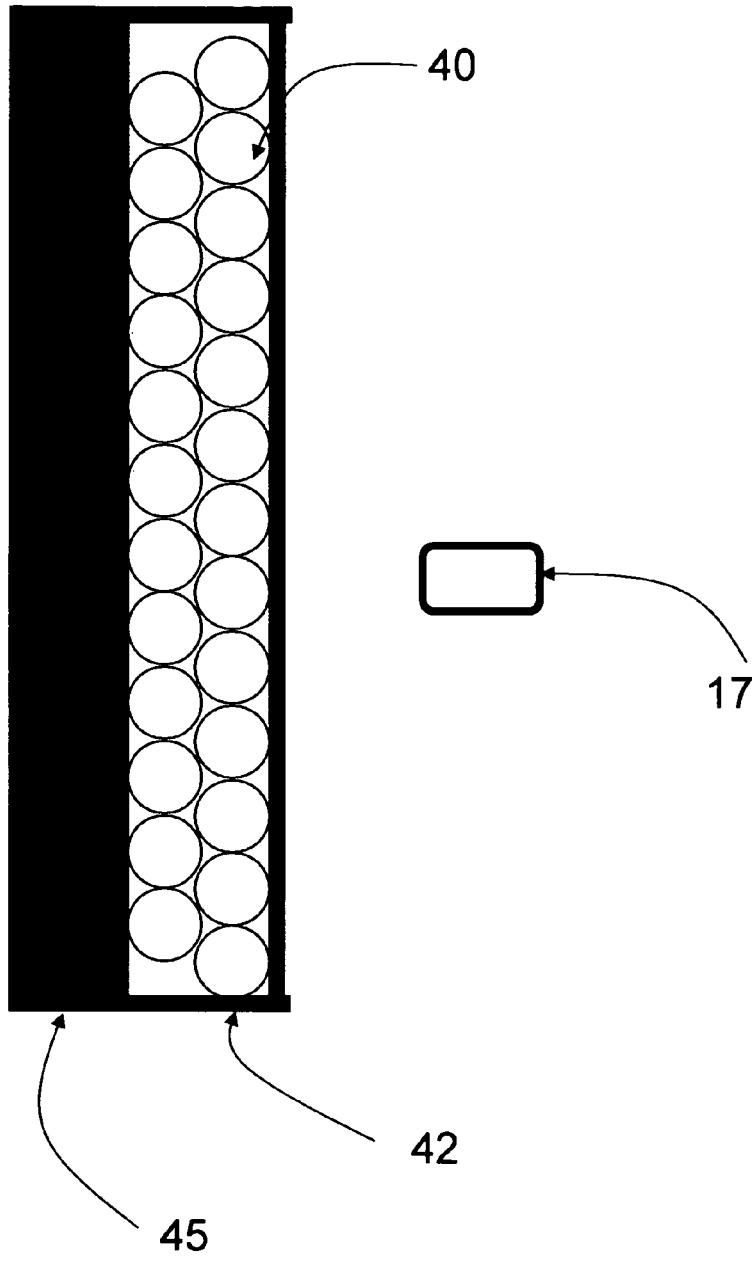

FIG. 11 is similar to FIG. 10 only that two ballistic ball columns are used rather than three or more. The two rows of ballistic balls 40 provide maximum oblique surfaces to the penetrator 17 with minimal weight. The size of the balls will vary in accordance with threat size and maximum allowable ballistic weight allowed.

Figure 1:
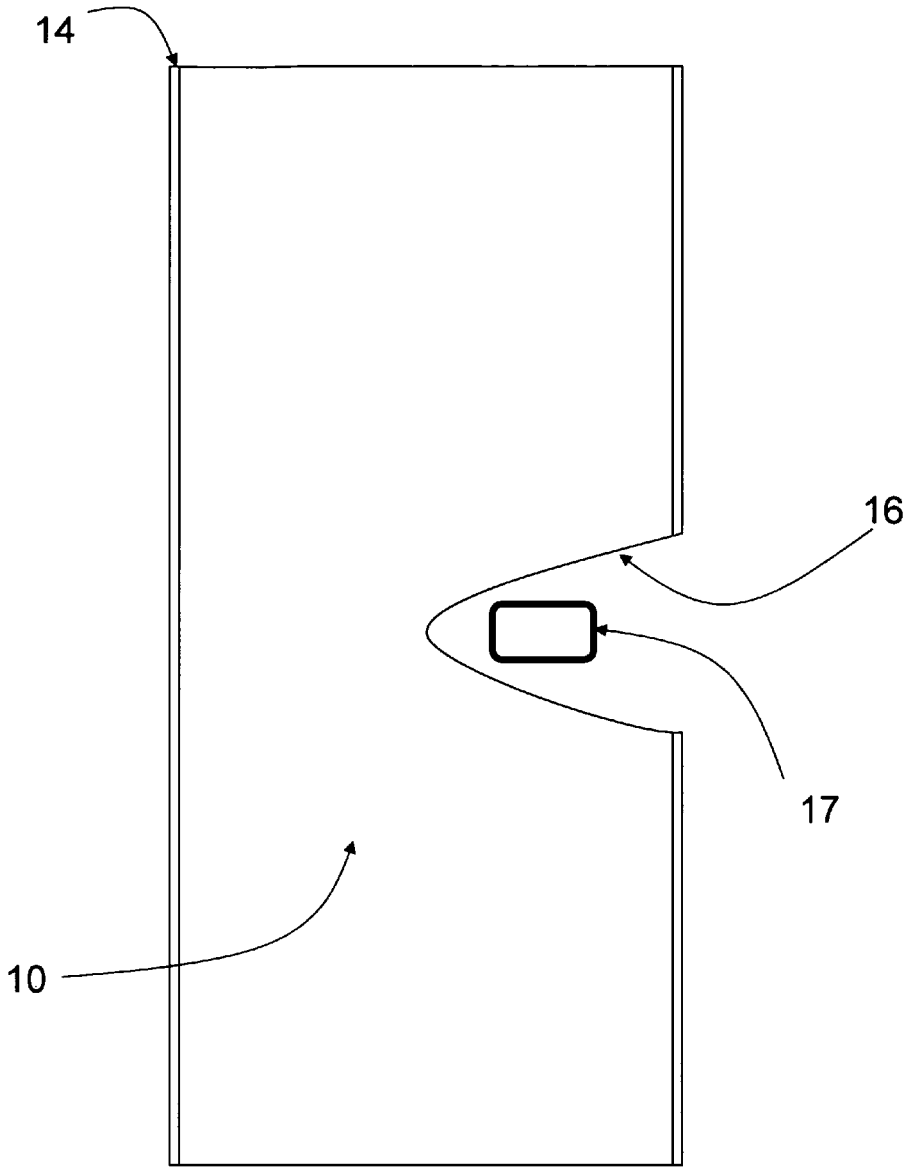
Figure 2:
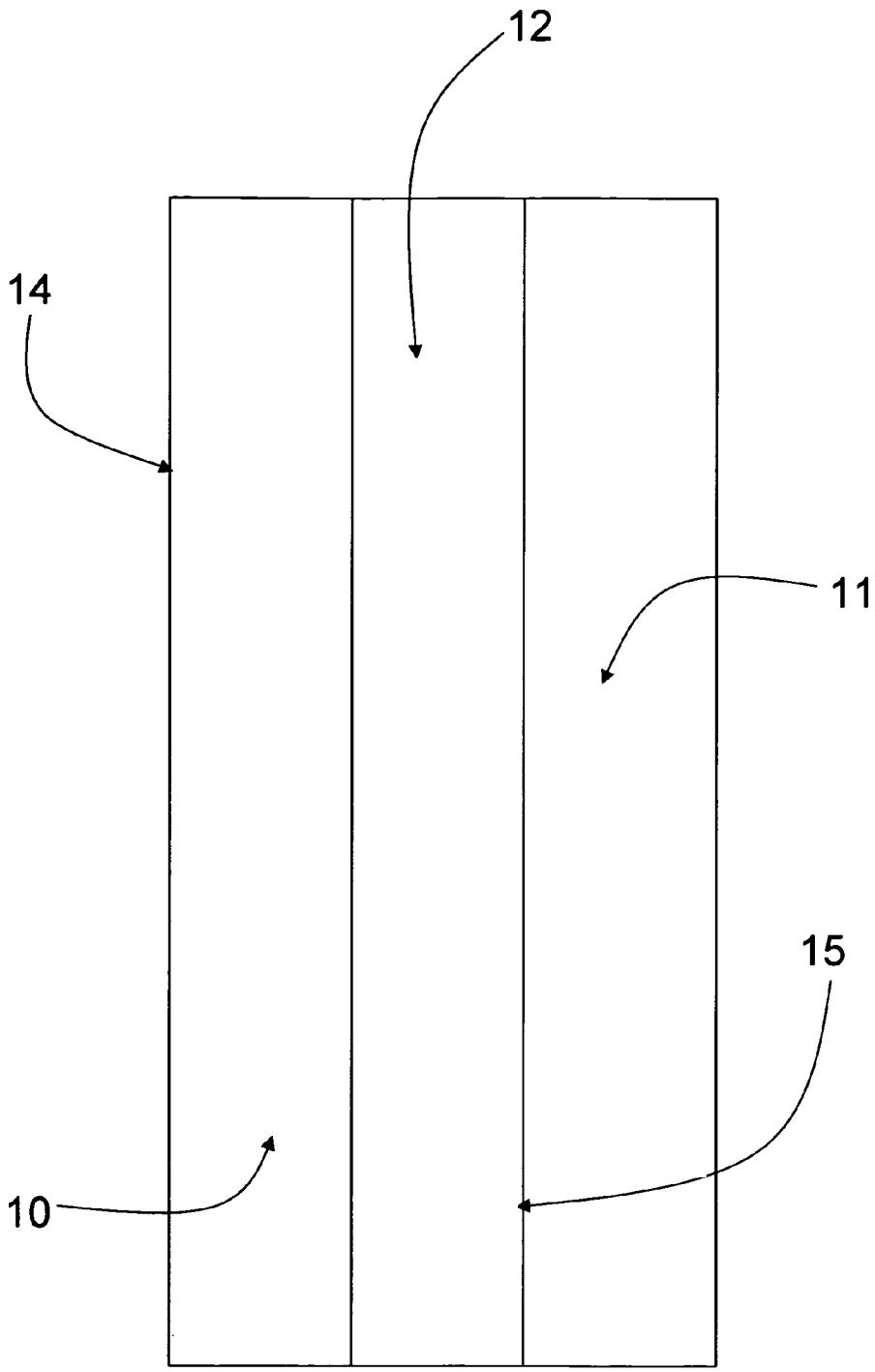
Figure 3:
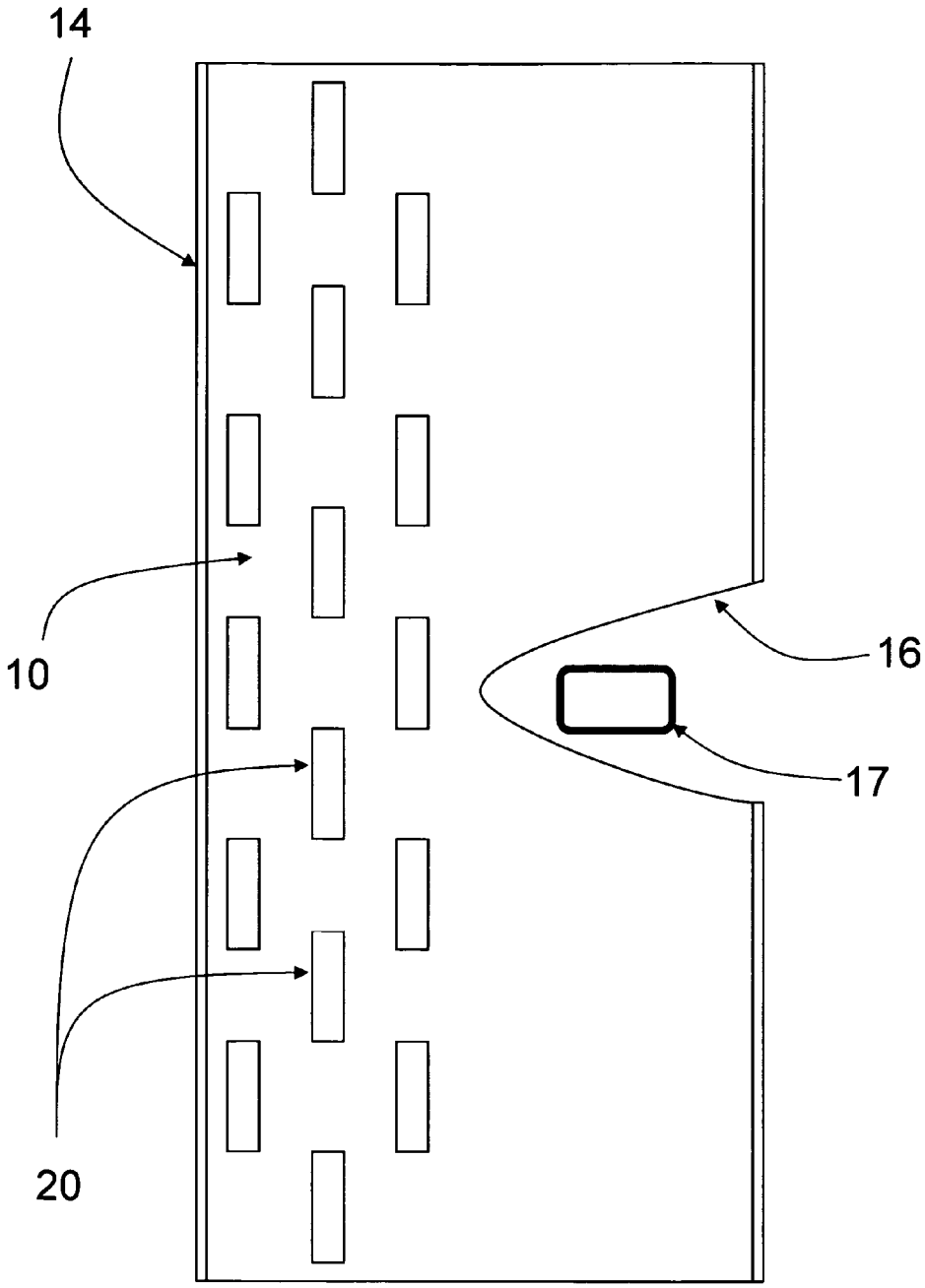
Figure 4:
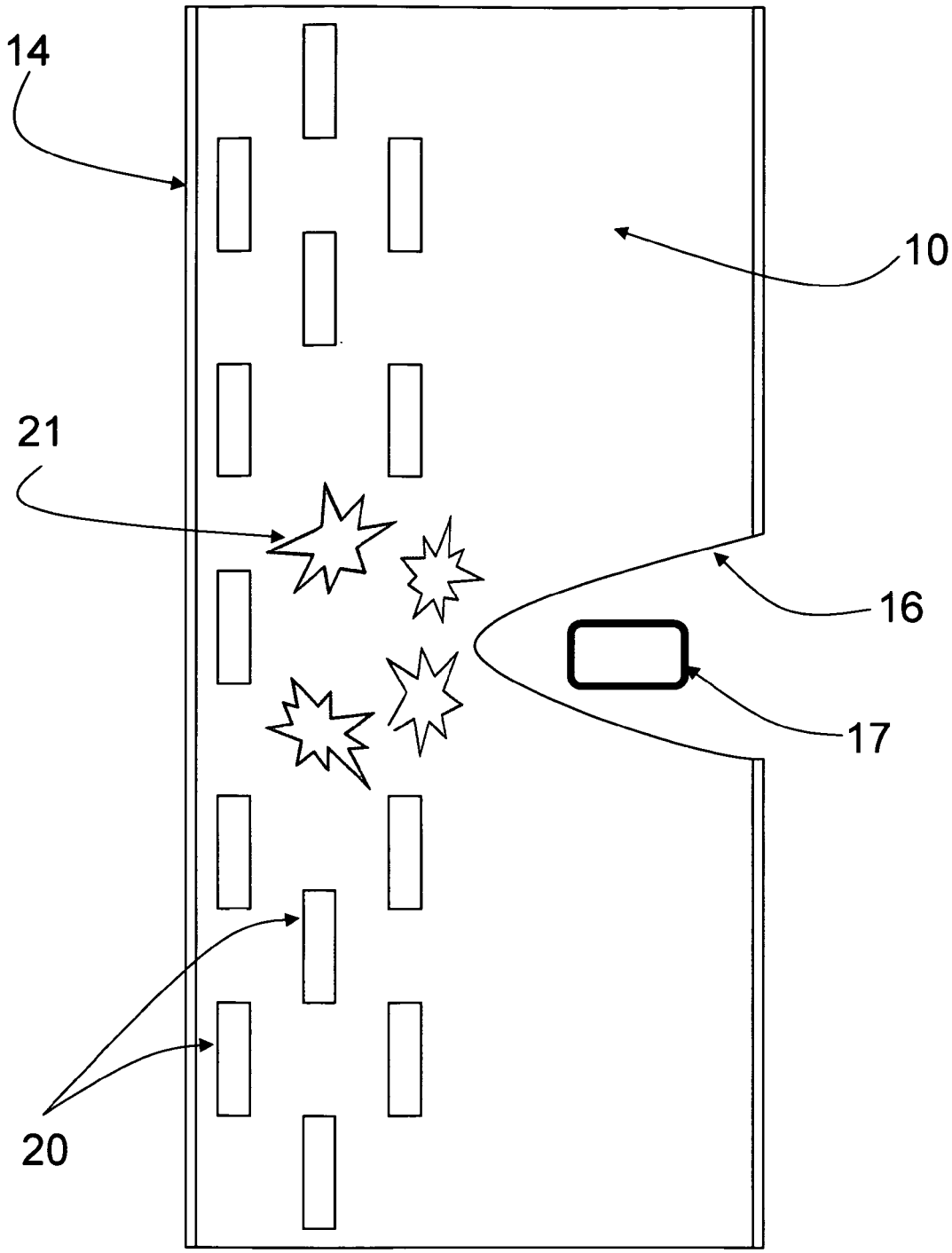
Figure 5:
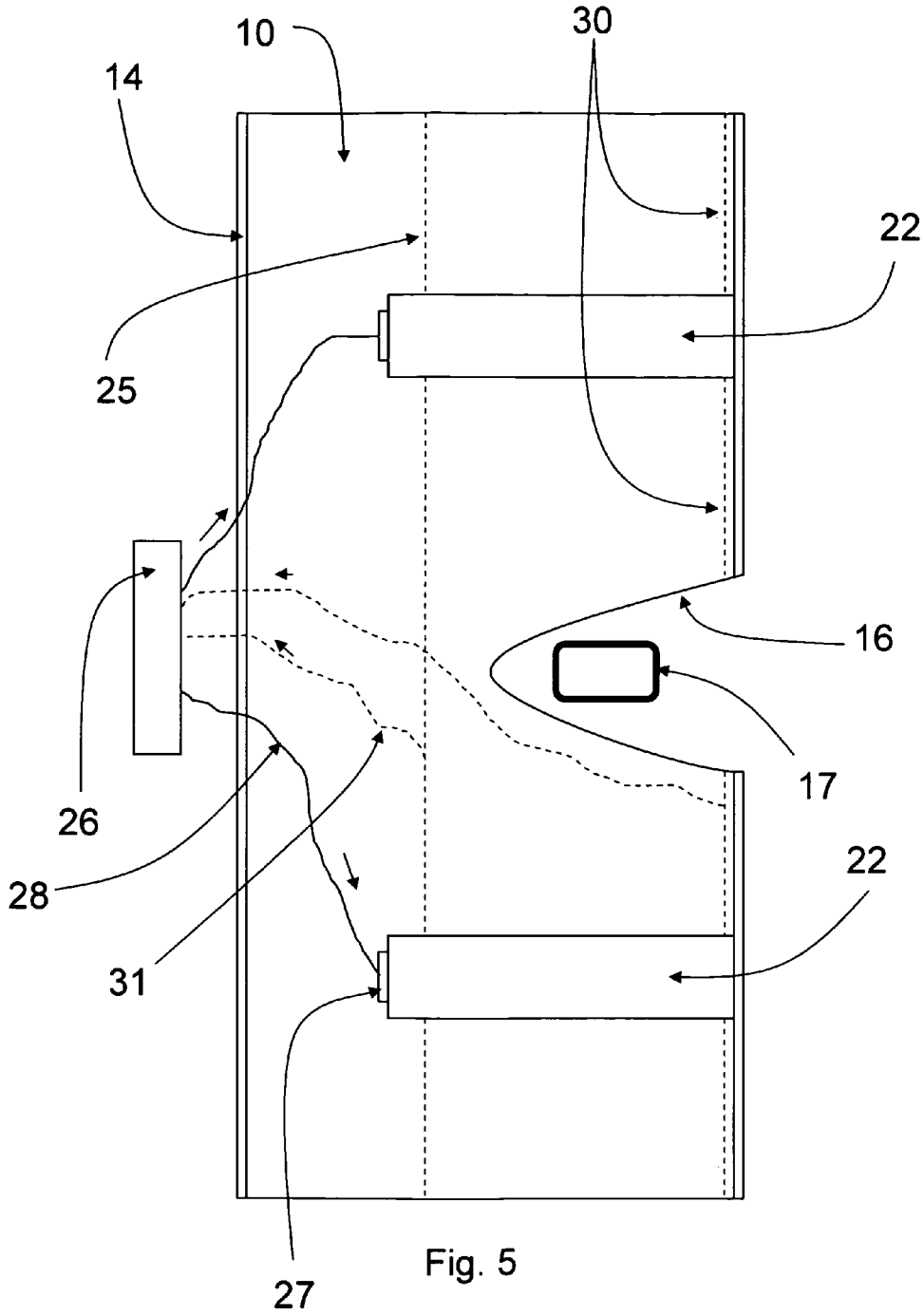
Figure 6:
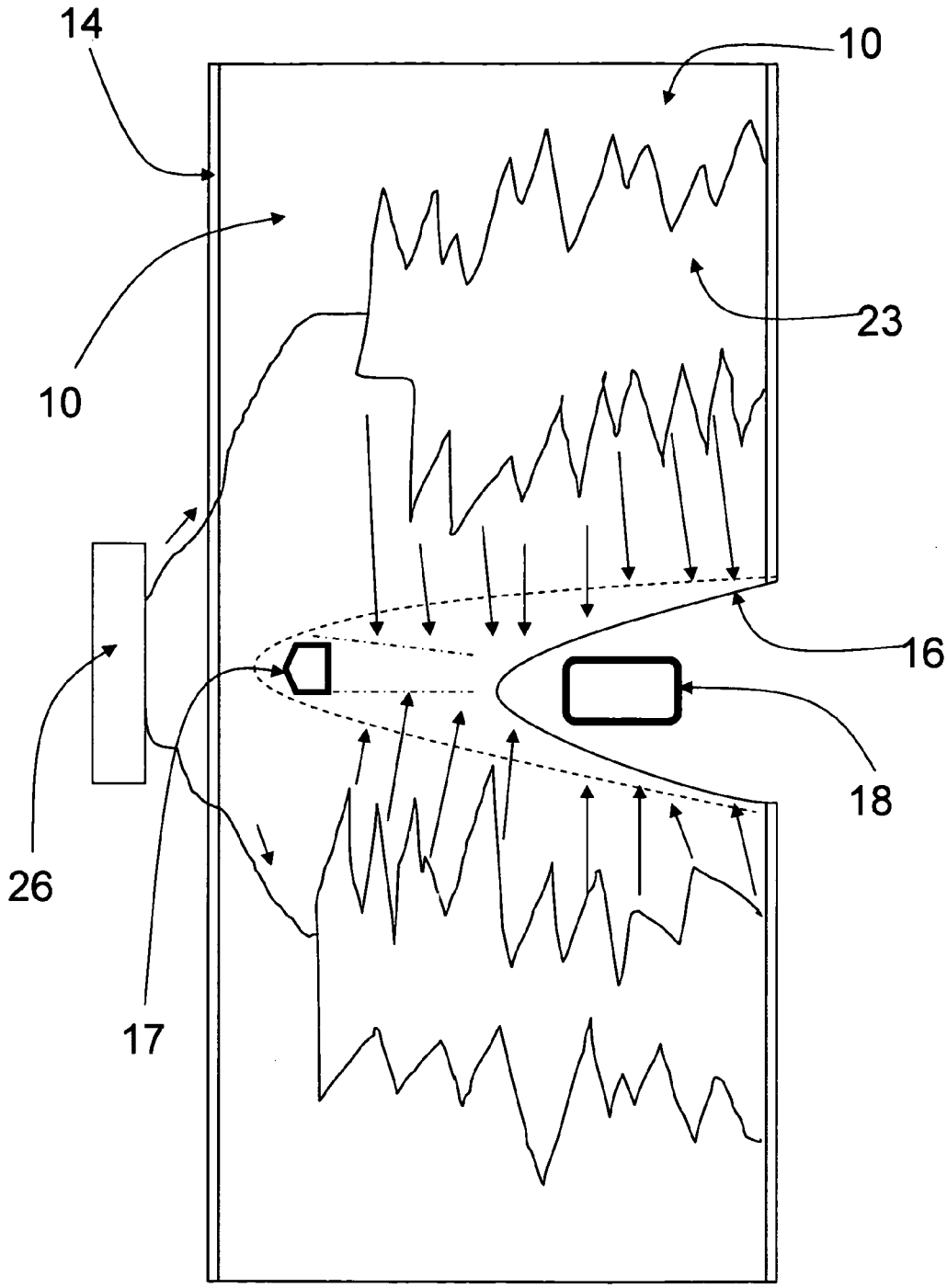
Figure 7:
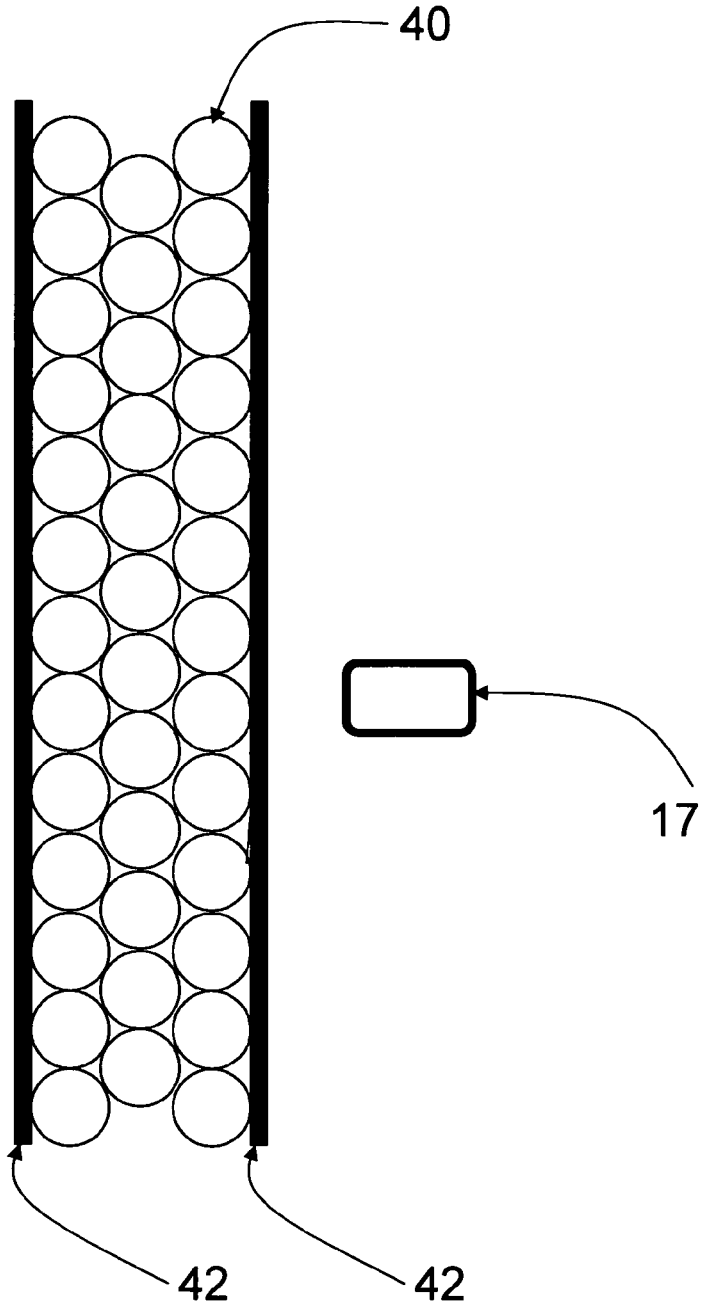
Figure 8:
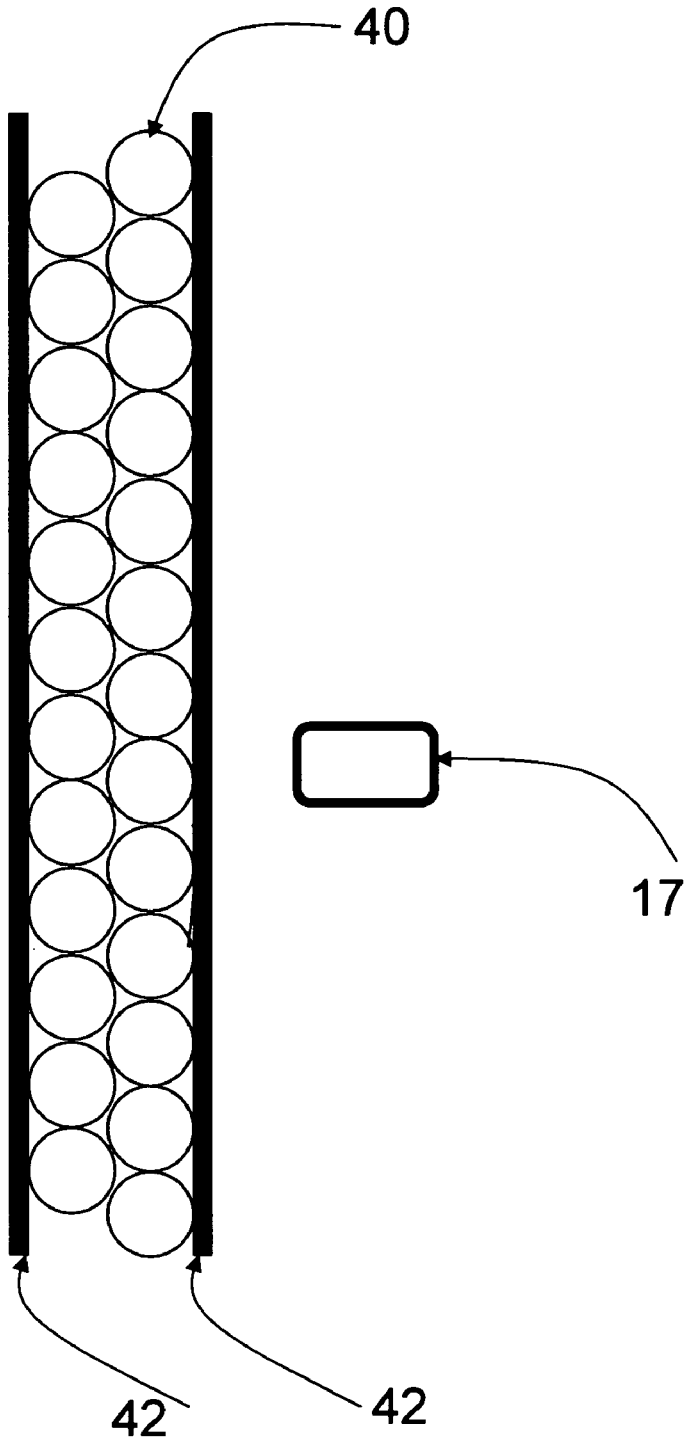
FIG. 8 is similar to FIG. 7 only that two rows are used to minimize weight.
Figure 9:
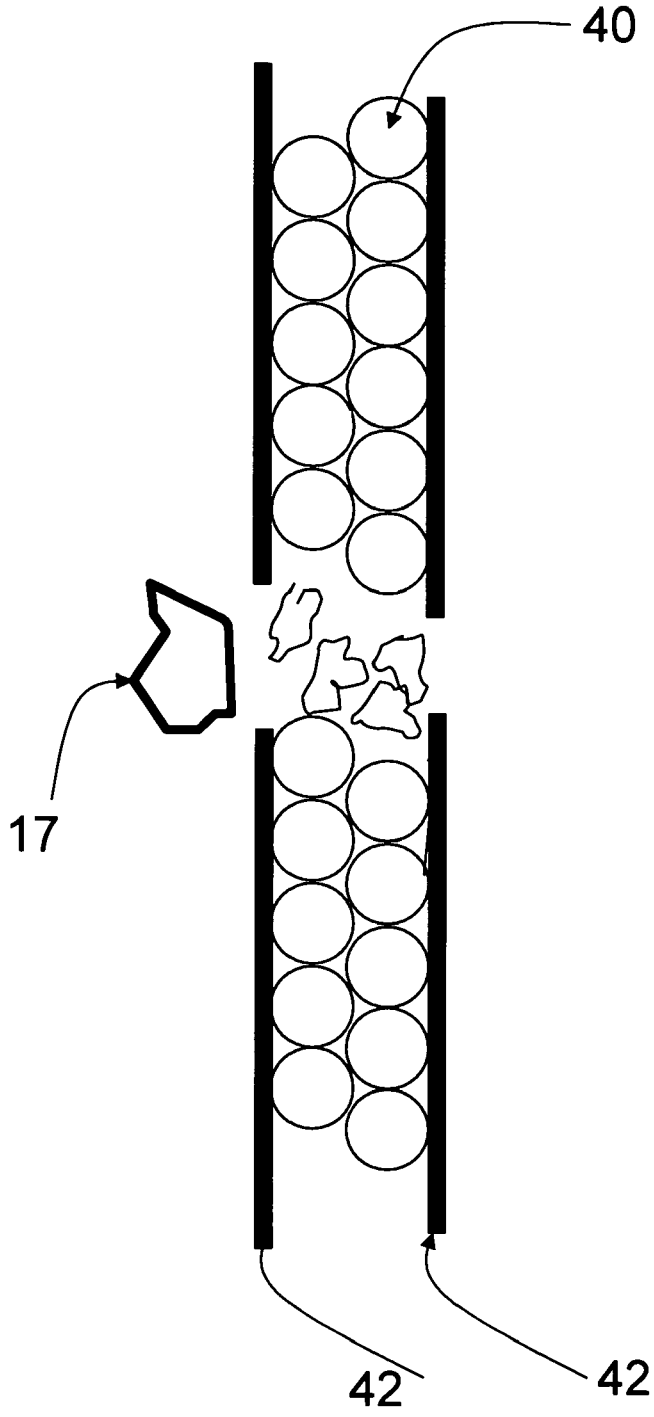
FIG. 9 shows the penetrator 17 blunted and fractured from colliding with the ballistic balls 40. The penetrator is then further reduced and stopped by the next series of effector plates or a base armor.
Figure 12:
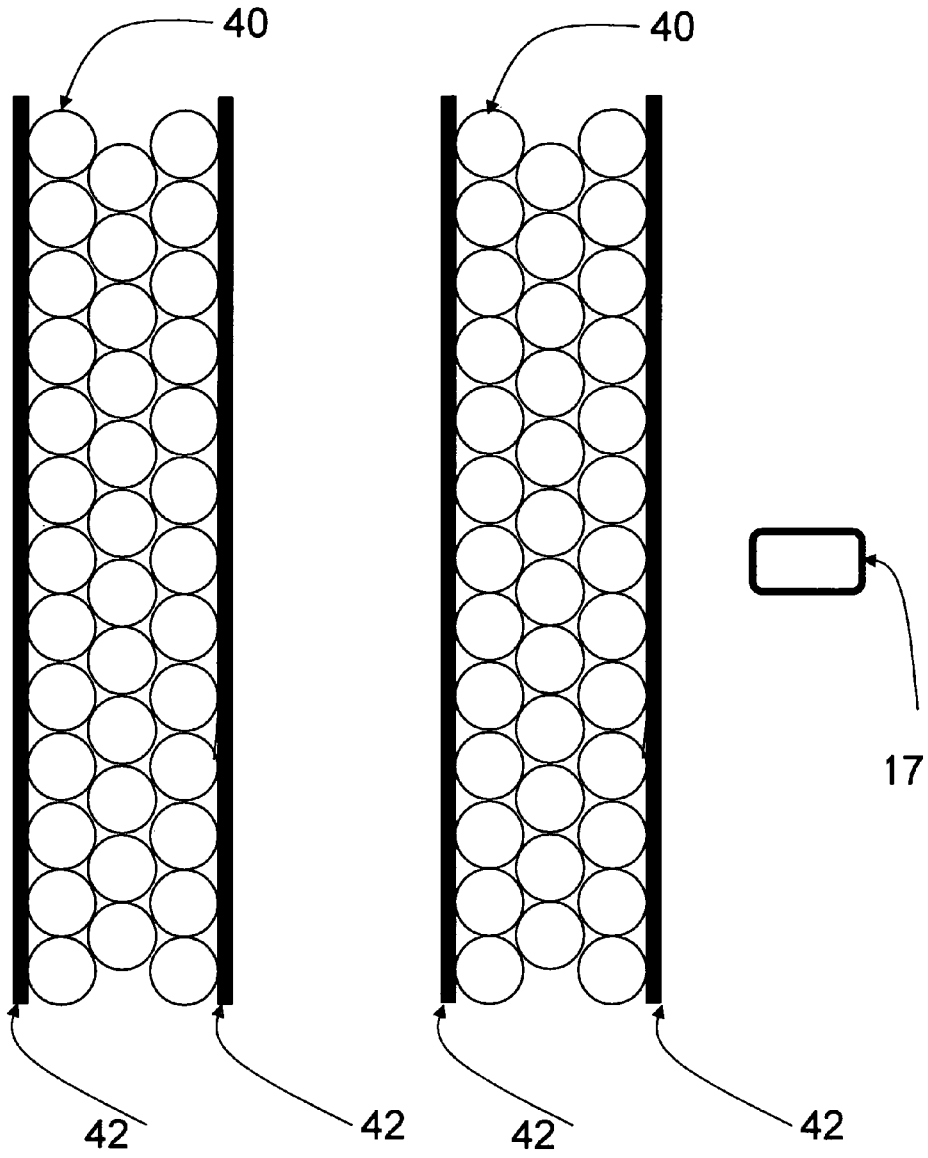

FIG. 12 is similar to FIG. 7 except that there are two effector plate boxes. The second set of effector plates are designed to further erode, disperse, rotate, slow down the incoming penetrator 17 and stop it in the second effector plate box or in the base armor of the vehicle.

Figure 13:
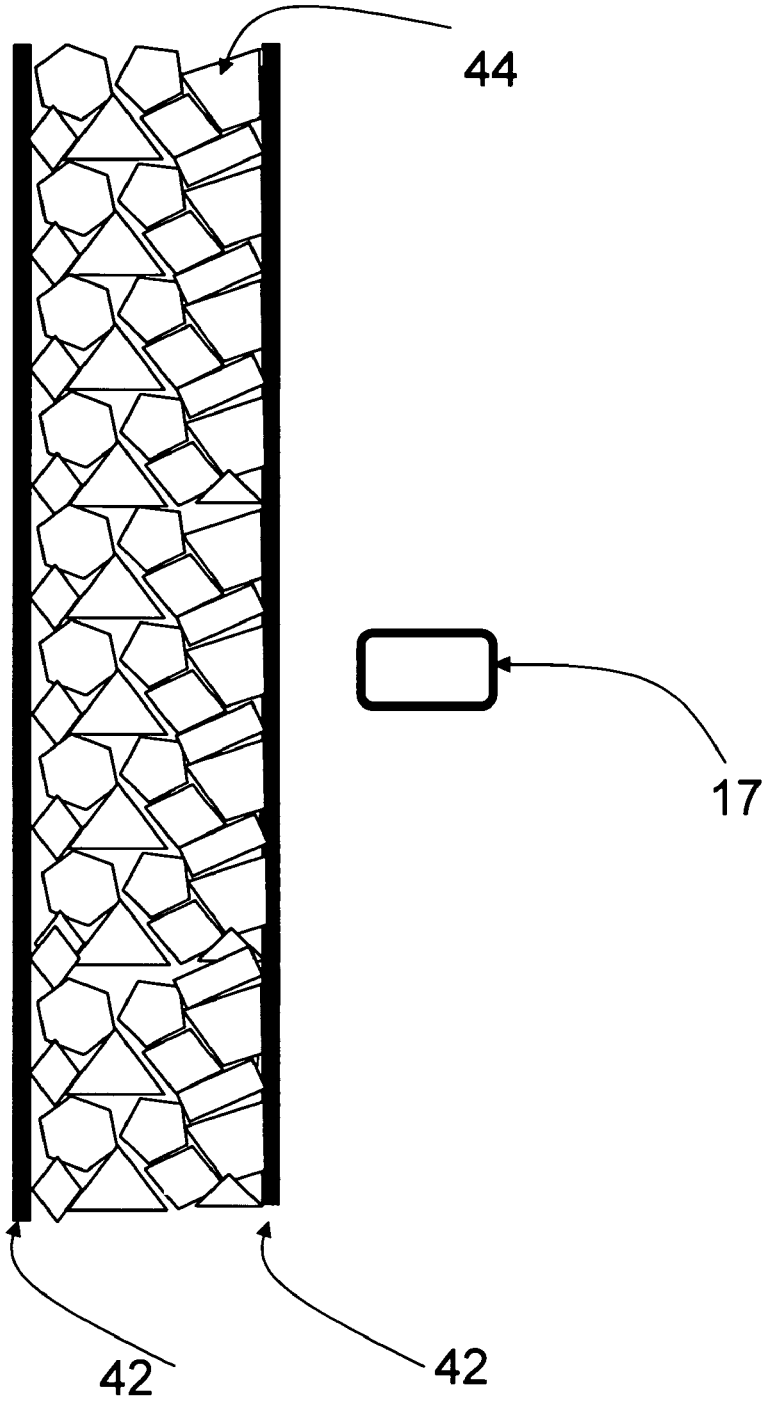

FIG. 13 is a low cost approach using inexpensive materials which also have irregular shapes. These shapes will blunt, erode, fracture, and rotate the incoming threat 17 to where it can be stopped in the next armor package or in the vehicle's base armor.

The invention claimed is:

1. An eroding particle armor system, comprising:

container adapted to be associated with a vehicle;

an internal particle armor comprising a volume of at least one particulate material selected from a group consisting of garnet, crushed ceramics, glass, silicon, and rocks; and explosive materials arranged throughout the particulate material to move said internal particle armor to disrupt a penetrator entering said container and close a cavity created by the penetrator.

2. The eroding particle armor system of claim 1 wherein the container is made of metal or composite material.

3. The eroding particle armor system of claim 1 further comprising an explosive ignition system that ignites said explosive material when said penetrator reaches a predesigned triggering point in said container.

4. The eroding particle armor system of claim 1 further comprising material binder dispersed throughout the internal particle armor and the explosive materials.

5. The eroding particle armor system of claim 1 wherein the particulate materials are in the shape of balls or spheres.

6. The eroding particle armor system of claim 1 wherein the explosive materials are in the shape of disks that have the sensitivity to ignite given the proper pressure.

7. The eroding particle armor system of claim 1 wherein the explosive materials are in the shape of rods along with an electric detonator.

8. The eroding particle armor system of claim 1 further comprising a ballistic back plate that will catch and absorb dispersed penetrator particles.

9. Eroding particle armor, comprising:

a container having one or more sections;

one or more volumes of loose particulate material filling the one or more sections;

one or more explosive rods arranged within the one or more volumes of loose particulate material in an equally spaced, three-dimensional lattice, perpendicular to an impacting face of the container;

one or more triggering membranes arranged parallel to an impacting face of the container;

a control unit; and control circuitry operatively connecting the one or more triggering membranes to the control unit and the one or more explosive rods.

10. The eroding particle armor of claim 9, wherein the container is made of metal or composite material.

11. The eroding particle armor of claim 9, further comprising a material binder dispersed throughout the one or more volumes of loose particulate material.

12. The eroding particle armor of claim 9, further comprising explosive pills that ignite when inundated with pressure of an impacting EFP or RPG.

13. The eroding particle armor of claim 9, further comprising a ballistic back plate attached to a face of the container that is opposite to the impacting face of the container.

14. The eroding particle armor of claim 9, wherein the particulate materials are in a ballistic ball shape.

* * * * *